US007878141B2

(12) United States Patent
Paynton et al.

(10) Patent No.: US 7,878,141 B2
(45) Date of Patent: Feb. 1, 2011

(54) AIRBAG SYSTEM FOR USE IN AN AVALANCHE

(75) Inventors: Dwayne Ralph Paynton, Winlaw (CA); Jason Howard Cloyd, Golden, CO (US); Bruce Jencks Edgerty, Boulder, CO (US); Eric Steven Moore, Arvada, CO (US)

(73) Assignee: Backcountry Access, Inc., Boulder, CO (US)

( * ) Notice: Subject to any disclaimer, the term of this patent is extended or adjusted under 35 U.S.C. 154(b) by 141 days.

(21) Appl. No.: 12/357,383

(22) Filed: Jan. 21, 2009

(65) Prior Publication Data

US 2010/0184343 A1 Jul. 22, 2010

(51) Int. Cl.
*A63B 29/02* (2006.01)
*A62B 33/00* (2006.01)
*A63C 9/18* (2006.01)

(52) U.S. Cl. ..... 116/210; 182/3; 137/888

(58) Field of Classification Search ..... 116/209, 116/210; 137/114, 888, 895; 182/3; 441/41, 441/80, 88, 92, 96, 129
See application file for complete search history.

(56) References Cited

U.S. PATENT DOCUMENTS 3,362,034 A 1/1968 Oldham
4,412,568 A * 11/1983 Hughes ..... 141/392
4,635,754 A 1/1987 Aschauer et al.
4,943,252 A 7/1990 Manix
5,150,767 A * 9/1992 Miller ..... 182/137
5,301,631 A 4/1994 Vining
6,158,380 A 12/2000 Aschauer et al.
6,220,909 B1 4/2001 Aschauer et al.
6,270,386 B1 8/2001 Visocekas
6,298,487 B1 10/2001 Mayhew (Continued)

FOREIGN PATENT DOCUMENTS

AT 10 934 U1 1/2010

(Continued)

OTHER PUBLICATIONS

International Search Report and Written Opinion by the International Searching Authority for PCT/US2010/02169, Jul. 14, 2010, pp. 1-10.

*Primary Examiner*—R. Alexander Smith
(74) *Attorney, Agent, or Firm*—Christoper J. Kulish

(57) ABSTRACT

The present invention is directed to an airbag system that a user can deploy to reduce the chances of being buried in an avalanche or if buried, likely being buried near the surface, thereby improving the user's chances of surviving the experience. In one embodiment, the airbag system is comprised of an inflatable balloon, a pressure gas cylinder for holding a pressurized gas that is used in inflating the balloon, a valve that can be placed in a closed state to retain a pressurized gas in the pressure gas cylinder or an open state in which pressurized gas is released from the pressure gas cylinder. The system further comprises an ejector that operates to use pressurized gas received from the pressure gas cylinder and ambient air to inflate the balloon. Also part of the system is a flow restrictor that is located to receive pressurized gas from the pressure gas cylinder before the ejector receives the gas. A harness supports the noted elements of the system adjacent to an individual's body.

19 Claims, 8 Drawing Sheets

U.S. PATENT DOCUMENTS

| | | | | |
|---|---|---|---|---|
| 6,347,970 | B1 | 2/2002 | Weinel | |
| 6,494,756 | B2 * | 12/2002 | Michaud et al. | 441/41 |
| 7,083,487 | B2 | 8/2006 | Weinel | |
| 7,261,608 | B2 | 8/2007 | Haddacks | |
| 7,264,525 | B2 | 9/2007 | Tsitas | |
| 7,270,077 | B2 | 9/2007 | Beck | |
| 2002/0123277 | A1 | 9/2002 | Weinel | |
| 2006/0107952 | A1 | 5/2006 | Schlosser | |
| 2007/0117479 | A1 | 5/2007 | Weinel et al. | |
| 2008/0121285 | A1 | 5/2008 | Weinel | |
| 2008/0257643 | A1 | 10/2008 | Weinel et al. | |
| 2009/0239428 | A1 | 9/2009 | Berchten | |
| 2010/0112880 | A1 | 5/2010 | Aschauer | |

FOREIGN PATENT DOCUMENTS

| | | | |
|---|---|---|---|
| DE | 40 03 683 | A1 | 8/1991 |
| DE | 195 16 872 | A1 | 11/1996 |
| DE | 195 45 864 | C2 | 6/1997 |
| DE | 198 07 109 | A1 | 5/1999 |
| DE | 198 22 402 | A1 | 11/1999 |
| DE | 299 09 637 | U1 | 3/2000 |
| DE | 200 06 624 | U1 | 9/2001 |
| DE | 201 06 766 | U1 | 9/2001 |
| DE | 200 17 825 | U1 | 11/2001 |
| DE | 202 05 000 | U1 | 2/2003 |
| EP | 0 723 790 | A2 | 7/1996 |
| EP | 0 931 567 | A2 | 7/1999 |
| EP | 1 992 241 | A1 | 11/2008 |
| FR | 2 674 761 | A1 | 10/1992 |
| GB | 2 162 129 | A | 1/1986 |
| GB | 2 296 855 | A | 7/1996 |
| WO | 95/33389 | A1 | 12/1995 |
| WO | 98/33559 | A1 | 8/1998 |
| WO | 00/76589 | A1 | 12/2000 |
| WO | 2005/094620 | A1 | 10/2005 |
| WO | 2005/109982 | A2 | 11/2005 |
| WO | 2007/069100 | A1 | 6/2007 |
| WO | 2009/150309 | A1 | 12/2009 |

* cited by examiner 130
132
Φ3.45
A
A
34
120
Φ1.38
128
134
124
136
138
130
140
122
7.25
SECTION A-A
120
124
126
34
120
34

AIRBAG SYSTEM FOR USE IN AN AVALANCHE

FIELD OF THE INVENTION

The present invention relates to an airbag system that a user can deploy in an avalanche situation to increase the user's chances, if caught in the avalanche, of surviving the avalanche.

BACKGROUND OF THE INVENTION

Generally, avalanches are composed of snow structures that range in volume from the volume associated with an individual snow flake to a block of consolidated snow or ice that has a volume of several cubic meters. It has been found that the snow structures with larger volumes tend to stay on or migrate towards the surface of the avalanche, while snow structures with lower volumes stay on or migrate towards the bottom of the avalanche, i.e. migrate to a location nearer to the ground and further from the surface.

One way for an individual to increase their chances of surviving an avalanche is to inflate an airbag in an airbag system that is attached to the individual to increase the volume associated with the individual. Once the airbag is inflated, the volume associated with the individual is the volume of the individual plus the volume of the inflated airbag. The greater volume associated with the individual is likely to keep the individual at the surface of the avalanche or, if buried by the avalanche, near the surface of the avalanche, thereby increasing the individual's chances of surviving the avalanche.

Generally, airbag systems for use in avalanche situations employ at least one airbag or balloon, a pressure gas cylinder for holding the pressurized gas that is used to inflate the airbag, and a valve that can be opened to release the pressurized gas to inflate the balloon in an avalanche situation. Many airbag systems also employ an element known as an ejector to reduce the amount of pressurized gas that the user of the system must carry. The ejector receives the pressurized gas from the pressure gas cylinder when the valve is opened and uses the pressurized gas to draw in ambient air to create a gas stream for inflating the airbag that is a combination of gas from the pressure gas cylinder and the drawn-in, ambient air. At least one airbag system utilizes a two-stage ejector that inflates that airbag with gas from the pressure gas cylinder and two separate streams of ambient air.

SUMMARY OF THE INVENTION

The present invention is directed to an airbag system for use in avalanche situations that employs an ejector. However, relative to many known airbag systems that employ an ejector, the airbag system of the present invention is capable of inflating an airbag using less pressurized gas. More specifically, if these known systems and the airbag system of the present invention are each designed to fill an airbag of a specified volume, the airbag system of the present invention will require less pressurized gas than these known systems. As a consequence, the airbag system of the present invention can employ a smaller pressure gas cylinder that occupies less volume and, depending upon the design of and the material employed in the pressure gas cylinder and, is likely lighter than the pressure gas cylinders of these known systems.

In one embodiment, an airbag system is provided that is comprised of an inflatable balloon, a pressure gas cylinder for holding a pressurized gas for use in inflating the balloon, and a valve situated between the balloon and the pressure gas cylinder that can be placed in a closed state to retain the pressurized gas in the pressure gas cylinder and in an open state to release the pressurized gas from the pressure gas cylinder for use in inflating the balloon. The airbag system also employs an ejector that utilizes the gas released from the pressure gas cylinder to produce a gas stream for inflating the balloon that is a combination of the gas from the pressure gas cylinder and ambient air. The system also employs a flow restrictor that is located to receive, when the valve is in the open state, gas from the gas pressure cylinder before the gas is received by the ejector. When the valve is in the open state, gas is flowing from the pressure gas cylinder towards the balloon. The flow restrictor serves to drop the inlet gas pressure at the ejector such that the ejector operates more efficiently, i.e., is able to draw in a greater volume of ambient air into the combined gas stream provided to the balloon. In one embodiment, the airbag system was able to use approximately 40% less gas, i.e. the gas from the cylinder, than a known airbag system with a balloon of substantially equal inflated volume to the balloon employed in the present invention.

In another embodiment, the flow restrictor is located to receive, when the valve is in an open state, gas from the pressure gas cylinder before the gas is received by the valve. To elaborate, the valve is comprised of a movable block, a first port that is on the cylinder-side of the movable block, and a second port that is on the balloon-side of the movable block. The movable block operates to place the valve in: (a) a closed state in which gas from the cylinder is prevented from flowing from the first port to the second port and (b) an open state in which gas from the cylinder is allowed to flow from the first port to the second port. In this embodiment, the flow restrictor is located on the same side of the movable block as the first port. In another embodiment, the flow restrictor is located on the same side of the movable block as the second port, i.e., between the movable block and the ejector.

In yet a further embodiment, the airbag system further comprises a filling port that allows gas to be injected into the pressure gas cylinder. The filling port intersects the first port of the valve, i.e., the port that is on the cylinder-side of the movable block. Consequently, when the pressure gas cylinder is being filled, gas travels through the filling port and then through the first port into the pressure gas cylinder. In this embodiment, the flow restrictor is located between the intersection point and the bulk of the pressurized gas. Stated differently, the flow restrictor is located to receive gas when the valve is in an open state before the gas passes the intersection point of the filling port and the cylinder side port. By placing the flow restrictor at this location, the heating of the pressure gas cylinder that occurs during the injection of gas into the pressure gas cylinder during a typical filling operation is reduced.

Yet a further embodiment of the airbag system employs a flow restrictor and a single-stage ejector. As such, the ejector design is substantially less complicated than in airbag systems that employ a multi-stage ejector.

DETAILED DESCRIPTION

Figure 1A:
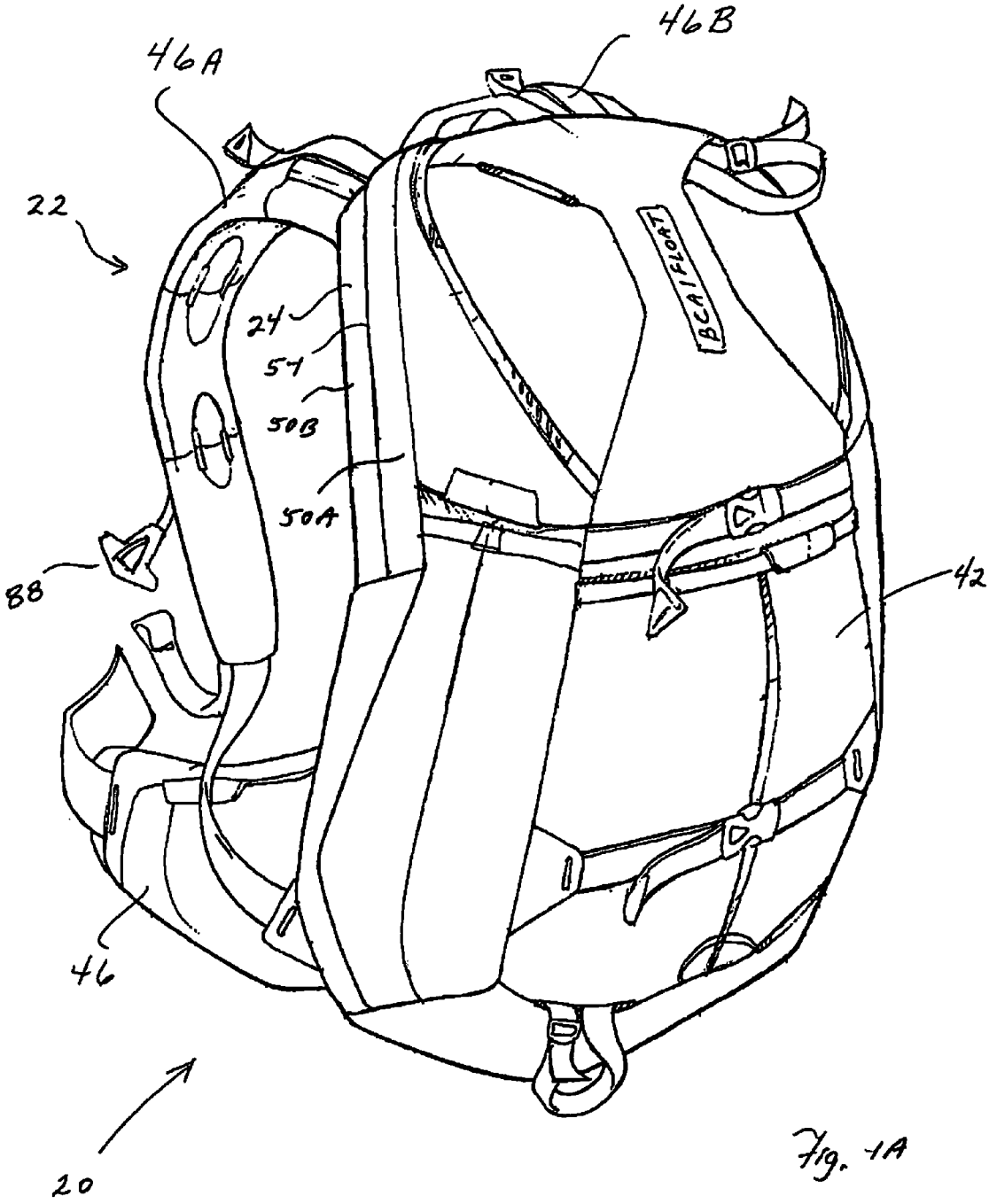
FIGS. 1A and 1B respectively, are rear and front perspective views of a backpack embodiment of the airbag system of the present invention.
Figure 1B:
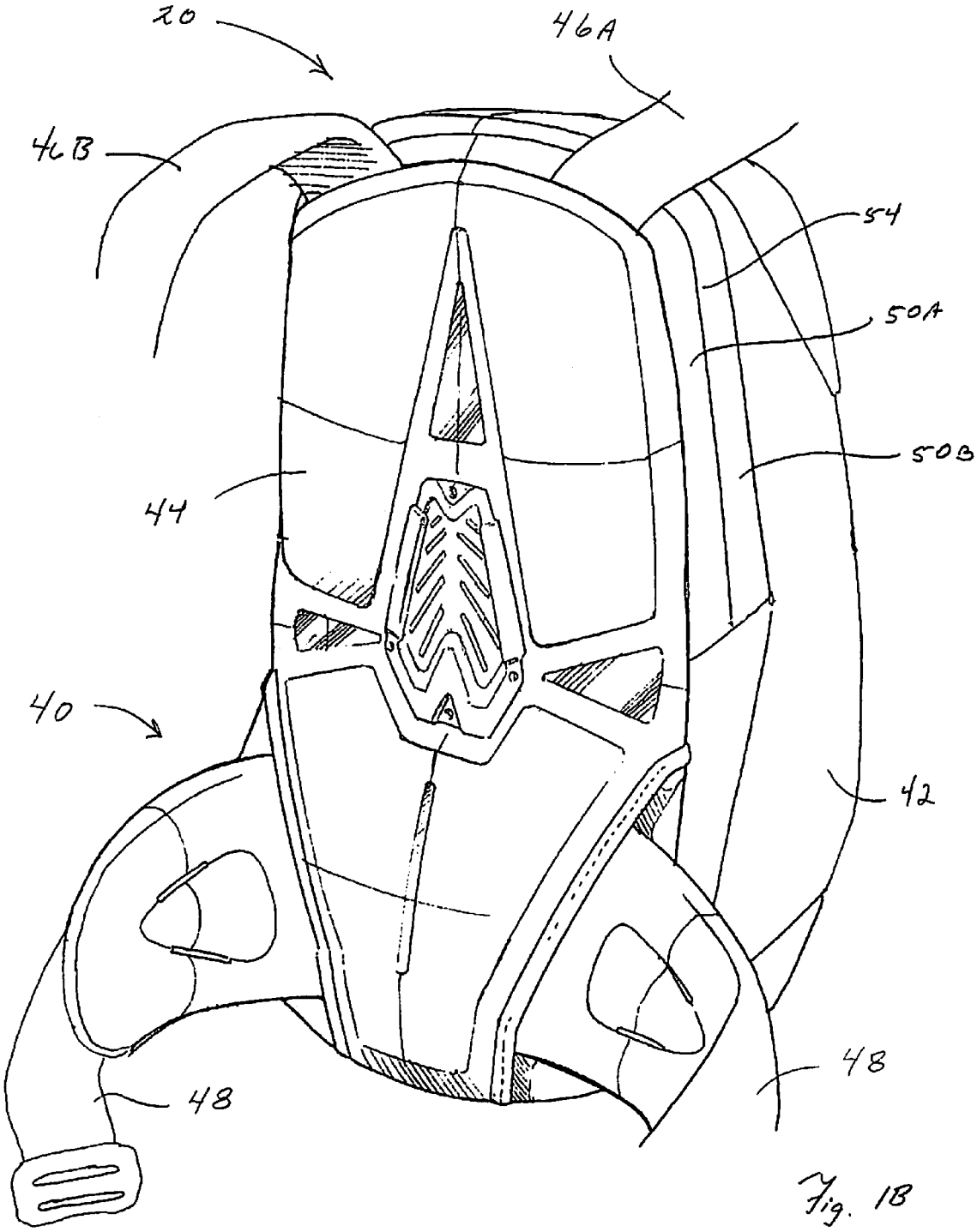
Figure 2:
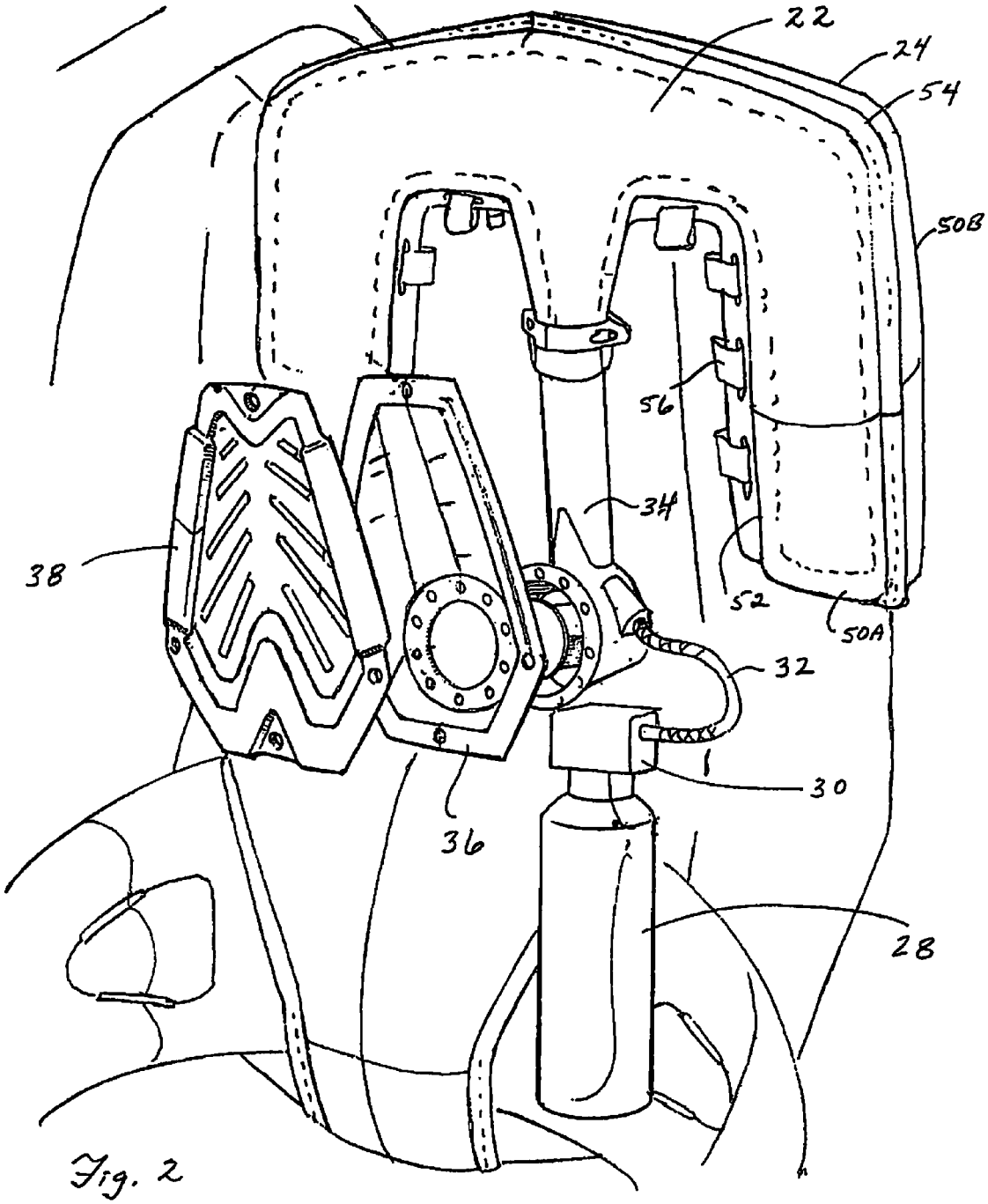
FIG. 2 illustrates the airbag related components of the backpack embodiment of the airbag system shown in FIGS. 1A and 1B.

FIGS. 1A, 1B, and 2 illustrate an embodiment of an airbag system for use in avalanche situation. The embodiment of the airbag system is hereinafter referred to as system 20. The system 20 is comprised of an inflatable balloon 22, a pocket 24 that holds the balloon 22 when deflated and opens when the balloon is being inflated, a pressure gas cylinder 28 for holding pressurized gas that is used to inflate the balloon 22, a valve and flow restrictor assembly 30, high-pressure tubing 32, a single-stage ejector 34 that receives gas provided by the cylinder 28 via the high-pressure tubing 32 and provides a combined stream of gas from the cylinder 28 and ambient air to the balloon 22, an air box 36, and air intake cover 38, a harness 40, and a sack 42 for holding a user's gear.

The harness 40 is used to support the other elements of the system 10 and to attach the other elements of the system 10 to a user. The harness 40 is comprised of a molded ethylene vinyl acetate (EVA) panel 44 that is commonly used in back packs, a pair of shoulder straps 46A, 46B that each engage the panel 44, and a buckled waist belt 48 that also engages the panel 44. It should be appreciated that the invention is capable of being used with any type of harness that is capable of: (a) supporting the other elements of the invention that are needed to store and deploy a balloon in an avalanche situation and (b) attaching these other elements adjacent to a user's body. Examples of other harnesses include climbing harnesses and packs that have metal ladder-frames, shoulder straps, and waist belts. Other examples of harnesses include items of clothing, such as jackets, vest, coats, parkas and the like. It should be appreciated that the other types of harnesses also suggest that the sack 42 is part of the backpack embodiment of the system but is not a necessary element of the system.

Figure 3:
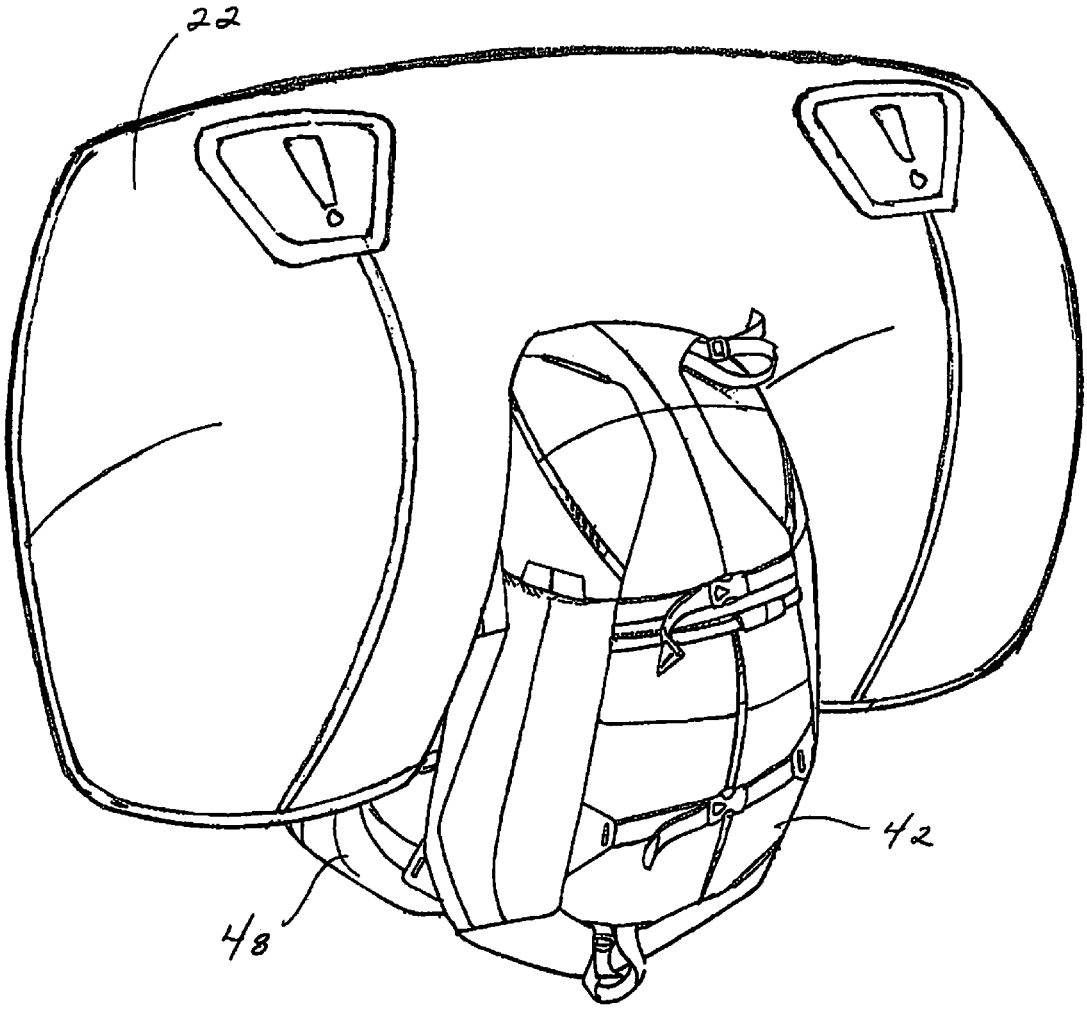
FIG. 3 illustrates the airbag of the backpack embodiment of the airbag system shown in FIGS. 1A and 1B in an inflated condition.

The inflatable balloon 22 is made of a tear resistant and substantially gas impermeable material, such as a coated nylon. Other materials are also feasible. With reference to FIG. 3, the balloon 22 is structured so that, when deployed by an individual that is properly wearing the harness, the inflated balloon occupies a space that is substantially behind a plane that is generally defined by the user's back and the panel 44. As such, the inflated balloon does not interfere with the user's ability to look forward and to each side. Further, the inflated balloon does not occupy the space defined by the normal range of motion of the user's legs. Consequently, the inflated balloon does not interfere with the user's ability to move their legs in attempting to evade or cope with an avalanche situation. The inflated balloon also does not occupy all or a substantial portion of the space in which a user is normally able to move their arms that is forward of the noted plane defined by the user's back and the panel 44. It should be appreciated that the invention is not limited to a particular balloon shape or deployment in a particular space relative to a user. The balloon shape and the space in which the balloon is deployed when in use can be adapted to different embodiments of the invention. The balloon is also structured so that when it is fully inflated, it occupies a space of about 150 liters.

The pocket 24 is defined by a front and rear portions 50A, 50B, a rear seam 52 that joins the front and rear portions 50A, 50B to one another, and an opening 54 that employs a fastener that is capable of closing the pocket 24 to store the balloon 22 but can be opened upon deployment of the balloon 22. In one embodiment, the fastener is a hook-and-loop type of fastener, such as a Velcro fastener. When a hook-and-loop fastener is employed, the Velcro fastener does not extend over a small portion of the opening 54 to facilitate the separation of the hook and loop elements of the fastener from one another when the balloon begins to inflate. The rear seam 52 also engages the rear end of the balloon 22. The rear seam 52 also includes a number of loops 56 through which a cord passes and is used to anchor the balloon 22 and pocket 24 to the panel 44. The fastening of the balloon 22 and pocket 24 to the panel 44 in this manner allows the balloon 22 and pocket 24 to be readily detached should the balloon 22 become damaged and require replacement or the balloon 22 otherwise needs to be removed, such as in a rescue situation. The pocket 24 is generally U-shaped to accommodate the shape of the balloon 22. Further, the pocket 24 is sized so that the balloon 24 fits tightly within the pocket 24, which also aids in the ability of the balloon 24 to deploy from the pocket 24 during the inflation operation.

With reference to FIG. 2, the pressure gas cylinder 28 is a stock pressure gas cylinder that is rated to at least 3000 psi and, at 3000 psi, contains approximately 42 standard liters of compressed gas. In the illustrated embodiment, the cylinder 28 preferably has a volume of less than 20 cubic inches of water, more preferably less than about 15 cubic inches of water. Typically, the cylinder 28 is filled with air. However, other gases, such as nitrogen, can also be used. Sites that are capable of filling the cylinder 28 up to at least the 3000 psi pressure rating include SCUBA shops, fire stations, and paintball facilities. The cylinder 28 includes a threaded opening for engaging the valve and flow restrictor assembly 30.

Figure 4A:
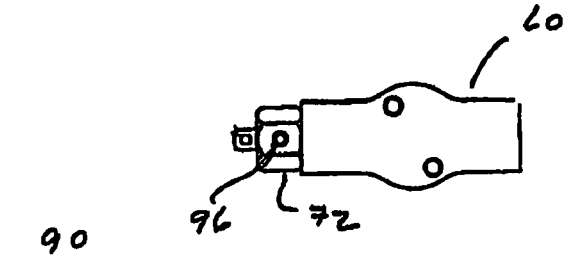
FIGS. 4A, 4B, and 4C respectively are top, side and end view of a valve and flow restrictor assembly.
Figure 4B:
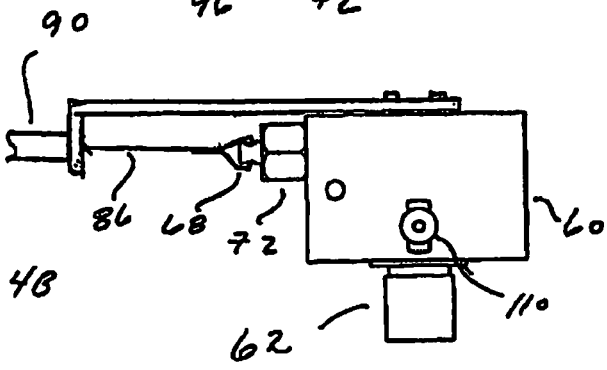
Figure 4C:
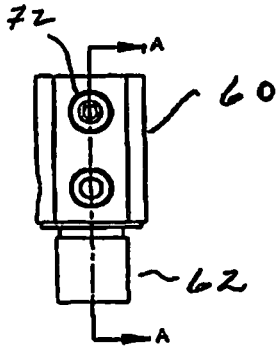
Figure 5:
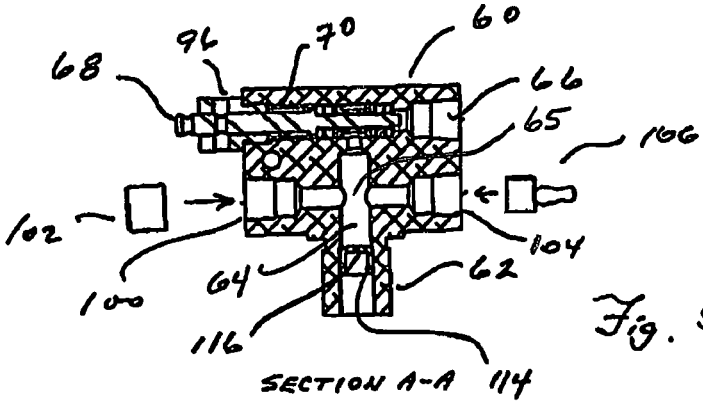
FIG. 5 is a cross-sectional view of the valve and flow restrictor assembly.

With reference to FIGS. 4A-4C, 5, and 6, the valve and flow restrictor assembly 30 is described in greater detail. The assembly 30 is comprised of a housing 60 with a threaded collar 62 for engaging the threaded opening of the cylinder 28. In connection with the valve, the housing 60 defines a path for pressurized gas to flow from the cylinder 28 and towards the balloon 22. The path includes a first port 64 that is in fluid communication with the interior of the cylinder 28 (the cylinder-side port) and a second port 66 that is in fluid communication with the balloon 22 via the ejector 34 and the high-pressure tubing 32 (the balloon-side port). Interposed between the first and second ports 64, 66 is a movable block element 68 that is capable of being positioned to place the valve in: (a) a closed state in which pressurized gas contained within the cylinder 28 is prevented from flowing from the first port to the second port and (b) an open state in which pressurized gas contained with the cylinder 28 is allowed to flow from the first port to the second port and on towards the balloon 22. In the illustrated embodiment, the movable block element 68 is comprised of a valve stem 68, a portion of which is capable of being moved into and out of the space within the housing 60 at which the first and second ports 64, 66 intersect one another to respectively place the valve in the closed and open states. The valve stem 68 is supported within a space 70 within the housing 60 by a threaded hex plug 72 that is engaged the housing 60, spacer tube 74, a pair of radial seal elements 76A, 76B to prevent the flow of gas past the valve stem 68 through the space 70, a pair of back-up rings 78A, 78B to prevent undue movement of the radial seal elements 76A, 76B through the space 70, and an annular flow spacer 80. The hex plug 72 and spacer tube 74 also serve to hold the radial seal elements 76A, 76B, back-up rings 78A, 78B, and annular flow spacer 80 in place within the space 70. With reference to FIG. 5, the valve stem 68 is positioned so as to place the valve in the closed state, i.e., communication of gas from the first port 64 to the second port 66 is prevented. The valve stem 68 is capable of, with reference to FIG. 5, being moved to the left to place the valve in the open condition to allow gas to flow from the first port 64 to the second port 66. A shoulder 82 of the valve stem 68 and the hex plug 72 cooperate to limit the leftward movement of the valve stem 68 and prevent the valve stem 68 from being totally removed from the space 70. It should be appreciated that in this embodiment the valve is a pressure balanced valve, i.e., a valve in which no active element (such as a spring) is required to counteract the pressure within the cylinder 28 to hold the valve in a closed state. This, in turn, allows the state of the valve to be changed from the closed state to the open state with a direct actuation device, i.e., an actuation device that does not need to overcome the operation of an active element in holding the valve in a closed state. It should also be appreciated that other valves can be used to control the flow of gas from the cylinder 28 to the airbag 22.

Figure 6:
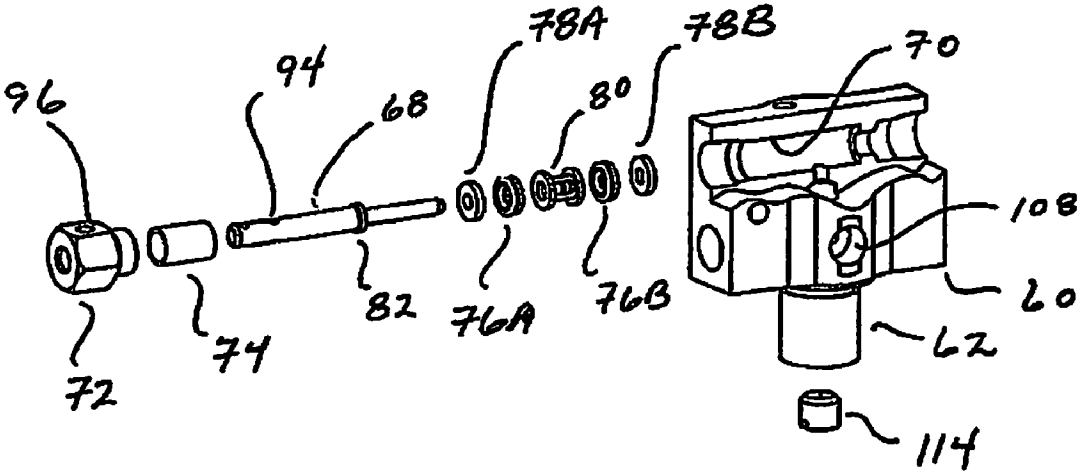
FIG. 6 is a exploded, cut-away view of the valve and flow restrictor assembly.
Figure 7:
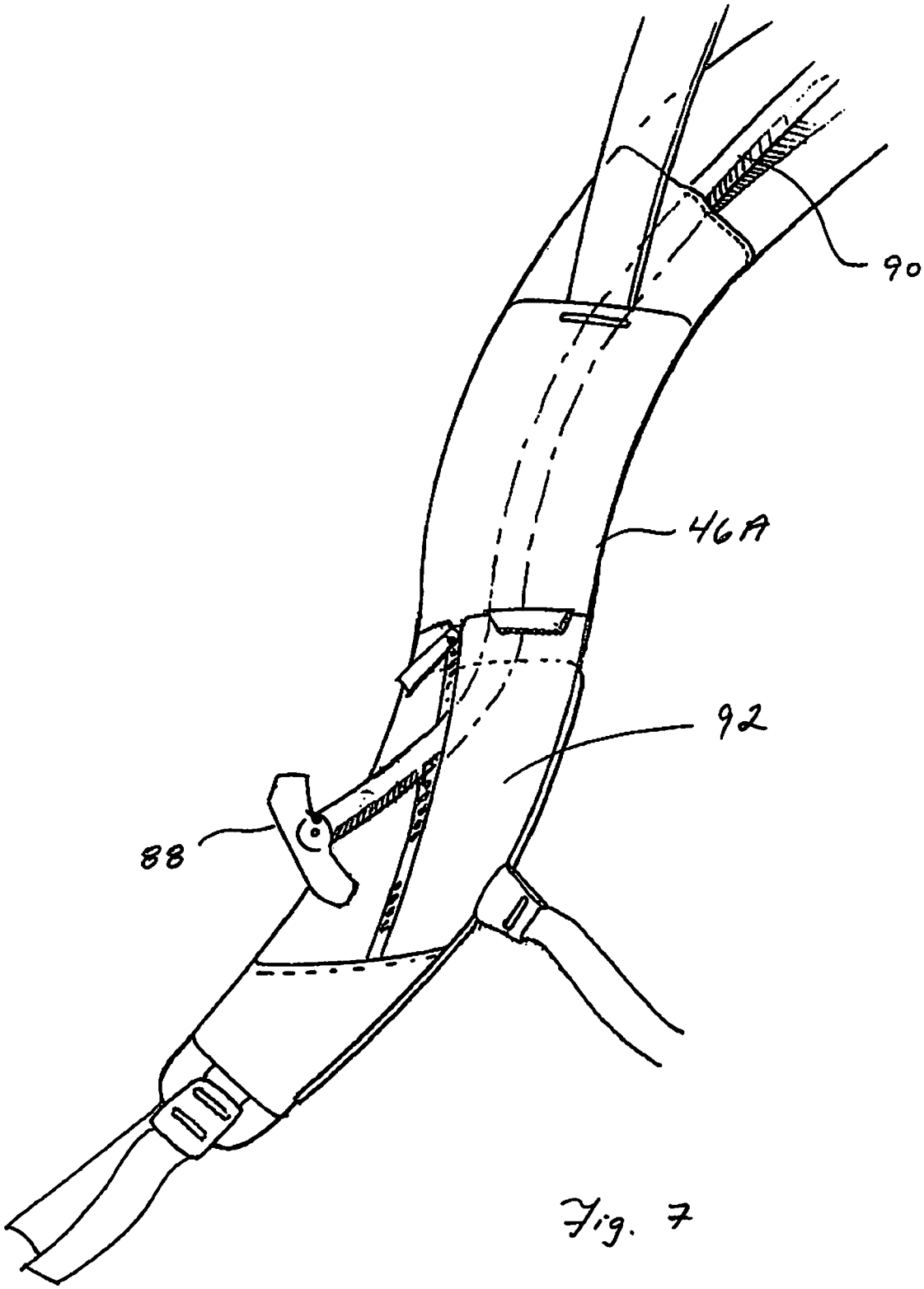
FIG. 7 illustrates a shoulder strap of the backpack embodiment of the airbag system shown in FIGS. 1A and 1B with a handle that is used to place the valve in open state to deploy the balloon and a pocket to prevent the handle from being pulled at an undesirable time.

With reference to FIGS. 4B and 7, displacement of the valve stem 68 from the position in which the valve is in the closed state (FIG. 5) to the position in which the valve is in the open state, is accomplished using a metal cord 86, one end of which is attached to the valve stem 68 and the other end of which is attached to a handle 88 located adjacent to shoulder strap 46A. The metal cord is housed within a sheath 90 to prevent the cord from abrading the materials of the shoulder strap 46A and other material associated with system 20 that is located between the handle 88 and the valve and flow restrictor assembly 30. To prevent the handle 88 from being inadvertently pulled and the valve placed in the open condition, a sealable pocket 92 for housing the handle 88 is associated with the shoulder strap 46A. With reference to FIG. 6, another feature that prevents the valve from being placed in the open state are the hole 94 in the valve stem and the hole 96 in the hex plug 72, which can be aligned and accommodate a cotter pin or similar device.

The housing 60 also defines a pressure sensing port 100 that communicates with the first port 64 and accommodates a threaded pressure indicator/gauge 102 that allows a user to determine if the cylinder 28 contains sufficient gas for inflating the balloon 22 before engaging in an activity in which the user might be exposed to an avalanche situation.

The housing 60 also defines a filling port 104 that communicates with the first port 64 at an intersection point 65 and accommodates a threaded, quick-connect one way valve 106. The valve 106 allows the air charging systems employed in fire stations, SCUBA/dive shops, paintball shops and the like to be used to inject air into the cylinder 28. As should be appreciated, the valve must be in the closed state in order for a charging system to inject air into the cylinder 28 up to the needed or desired pressure.

Also defined by the housing 60 is a burst port 108 that accommodates a threaded, burst plug 110 that is designed to vent the gas contained in the cylinder 28 if the pressure in the cylinder 28 exceeds a certain level, thereby reducing the possibility of the cylinder 28 exploding. In the illustrated embodiment, the burst plug 110 is designed to vent gas from the cylinder when the pressure within the cylinder 28 exceeds 4500 psi.

The housing 60 also contains a flow restrictor 114 that, when the valve is in the open state, reduces the pressure presented at the input to the ejector such that the ejector can draw in significantly more ambient air than if a flow restrictor is not employed. This, in turn, reduces the amount of gas that is needed from the cylinder 28. Consequently, a smaller cylinder 28 can be employed and, other things being equal, reduces the weight of the system 20. Further, the flow restrictor 114 produces a reasonably fixed pressure ratio as the flow of gas crosses it. As such, the pressure on the downstream side falls in time in proportion to the pressure in the cylinder 28. The flow restrictor 114 is a threaded plug that engages the first port and defines an orifice 116 having a diameter in the range of 0.010 to 0.060 inches and more preferably in a range of 0.020 to 0.040 inches. In the illustrated embodiment, the orifice of the flow regulator has a diameter of 0.030 inches. Using the flow restrictor 114 allowed a cylinder 28 that held approximately 41 standard liters of pressurized air at 3000 psi to operate in conjunction with the single-stage ejector 34 to fill a balloon with a fully inflated volume of 150 liters. The flow restrictor 114 is located in the first port 64 and between the filling port 104 and the end of the first port 64 that is furthest from the valve stem 68. As such, the flow restrictor 114 functions as previously noted when the valve is in the open state and gas is flowing from the cylinder 28 through the first and second ports 64, 66 and on towards the balloon 22. In addition, when the valve is in the closed state and gas is being injected into the cylinder 28 via the filling port 104, the flow restrictor 114 serves the additional function of keeping the cylinder 28 cooler than if the flow restrictor 114 was not present. It should be appreciated that a flow restrictor need not be located within a housing that also houses a valve, i.e., the flow restrictor can be embodied in a separate part that is operatively connected to the valve. Further, a flow restrictor can be located between the valve and the ejector. However, a flow restrictor so located does not provide the cooling benefit during filling of a flow restrictor that is located as illustrated in FIG. 5.

Figures 8A, 8B, 8C:
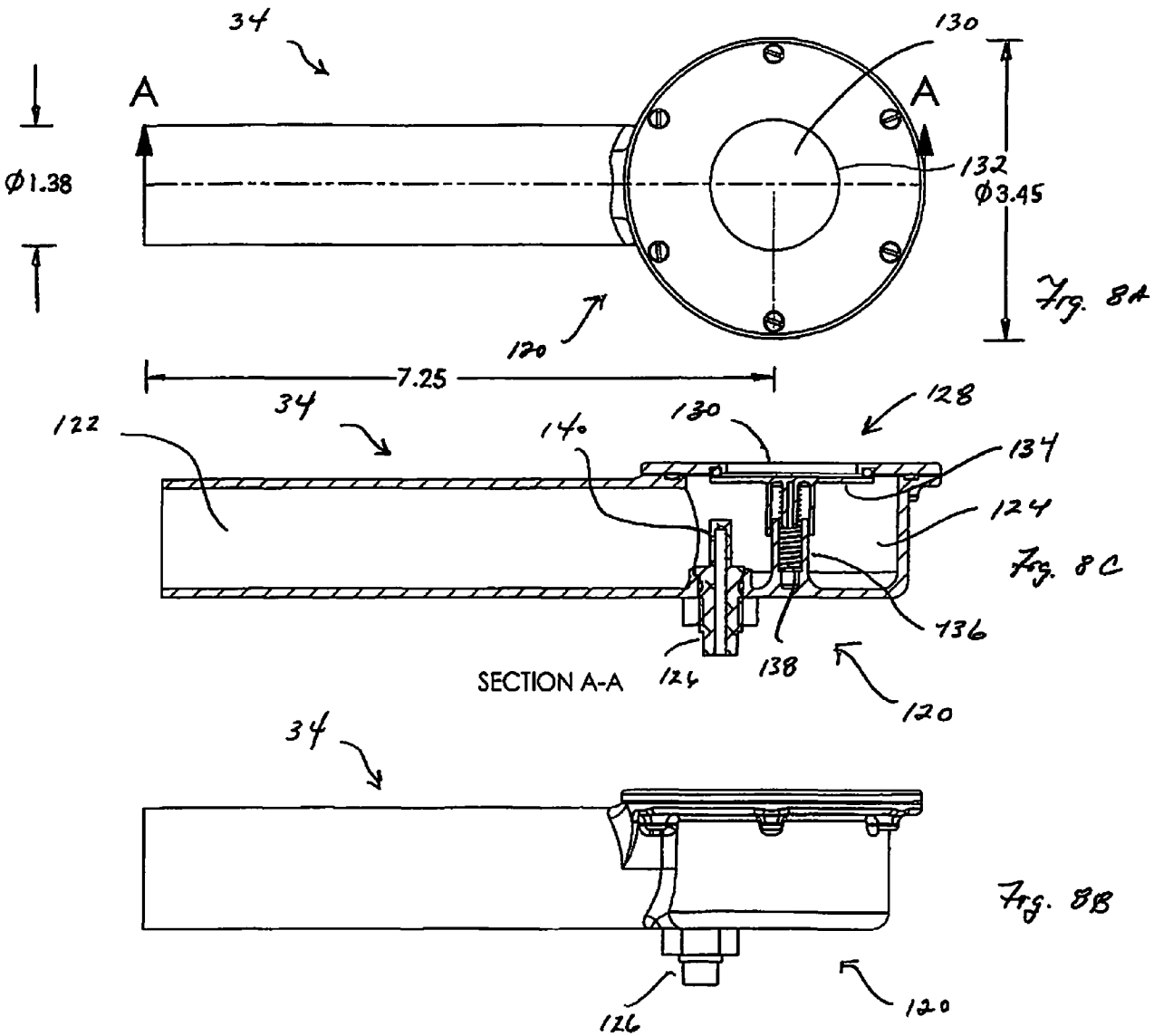
FIGS. 8A, 8B, and 8C respectively are top, side and cross-sectional views of a single-stage ejector used in the embodiment of the airbag system shown in FIGS. 1A and 1B.

With reference to FIGS. 8A-8C, the single-stage ejector 34 is comprised of a housing 120 that defines an outlet space 122 for conveying a gas stream that is a combination of gas from the cylinder 28 and ambient air to the balloon 22. The housing 120 also defines an inlet space 124 that receives gas from the cylinder 28 when the valve is in the open state and ambient air. The gas from the cylinder 28 is received into the inlet space 124 via an inlet port 126 that receives gas from the cylinder 28 via the valve and the high-pressure tubing 32. Ambient air is received into the inlet space 124 via a spring loaded port 128 that is open when the ejector 34 is receiving sufficient gas from the cylinder 28 to create a vacuum sufficient to overcome the force of a spring and closed when the ejector 34 is not receiving sufficient gas from the cylinder 28 to create a vacuum sufficient to overcome the force of the spring. The spring loaded port 128 is comprised of a circular port 130 that fits within a hole 132 defined by the housing 120, a generally T-shaped port mount 134 that engages the port 130 and spans a diameter greater than the diameter of the hole 132, a stand 136 that engages the mount 134, and a spring 138 housed within the stand 136.

In operation, the ejector 34 receives gas from the cylinder 28 via the inlet port 126. The received gas from the cylinder passes into the outlet space 122 via an orifice 140. In the illustrated embodiment, the orifice has a diameter of about 0.042 inches. Provided there is sufficient gas from the cylinder 28 being injected into the outlet space 122, a vacuum will be established on the interior side of the circular port 130. This will cause the port 130 to be displaced towards the spring 138 and will allow ambient air to pass through the hole 132 and into the outlet space 122, thereby creating a stream of gas for filling the balloon that is a combination of gas from the cylinder 28 and ambient air. Once there is insufficient gas from the cylinder passing into the outlet space to create a sufficient vacuum for overcoming the force of the spring 138, the circular port and T-shaped mount 134 will seal the hole 132, holding pressure in the balloon 22 by acting as a non-return valve.

With reference to FIG. 2, the air box 36 serves to establish a path for ambient air to be received by the ejector 34. As such, the air box 36 is connected to the portion of the housing 120 of the ejector 34 that includes the hole 132. The periphery of the air box 36 is connected to the rear side of the panel 44 and over a hole in the panel 44. With reference to FIG. 1B, the air intake cover 38 is connected to the front side of the panel 44 and over the hole in the panel 44. With reference to FIGS. 1A, 1B, and 2, it should be appreciated that the balloon 22, pocket 24, cylinder 28, high-pressure tubing 32, ejector 34, and air box 36 are all located on the rear side of the panel 44 and, as such, are protected by the panel 44 and the sack 42. Further, in the illustrated embodiment, the noted elements located on the rear side of the pack are accessible via the sack 42.

Operation of the system 20 involves placing the system 20 in a operable condition and, once the system 20 is in an operable condition, using the system 20 to deploy the balloon 22. Generally, placing the system 20 in an operable condition comprises: (a) placing the balloon 22 in the pocket 24 and engaging the fastener associated with the pocket 24, and (b) charging the cylinder 28 with gas to a sufficient pressure so that when the valve is placed in the open condition, the balloon 22 will deploy from the pocket 24. Preferably, placing the balloon 22 in the pocket 24 involves folding the balloon 22 in an accordion type fashion, positioning the folded balloon 22 in the pocket 24, and engaging the fastener associated with the pocket. To charge the cylinder 28, the valve is placed in the closed position, i.e., the valve stem 68 is position as shown in FIG. 5. Further, to prevent displacement of the valve stem 68 during the filling process, the hole 94 of the valve stem 68 is aligned with the hole 96 associated with the hex plug 72 and a cotter pin or similar device is placed in the aligned holes, thereby preventing the valve stem 68 from being inadvertently displaced and the valve placed in the open state. The cylinder 28 is then charged with gas by connecting the quick-connect one way valve 106 to a suitable charging device. Once the cylinder 28 is sufficient charged with gas, the charging device is disconnected from the valve 106. After the cylinder 28 is charged and when a user is in a possible avalanche situation, the cotter pin or similar device is removed so that the valve can be placed in the open state, if needed, and the handle 88 is removed, if needed, from the pocket 92. At this point, a user can cause the balloon 22 to be deployed from the pocket 24 by pulling on the handle 88 to place the valve in the open state. With the valve in the open state, gas from the cylinder 22 passes through the valve and flow restrictor assembly 30 and into the ejector 34. The ejector 34 operates to produce a gas stream that is a combination of the gas from the cylinder 28 and ambient air. The ejector 34 provides this combination gas stream to the balloon 22. The balloon 34, in turn, begins to inflate and eventually causes the fastener associated with the pocket 24 to release. At this point, the balloon 22 deploys from the pocket 24.

While the invention has been particularly shown and described with reference to various embodiments thereof, it will be readily understood by those skilled in the art that various changes in the form and detail may be made without departing from the spirit and scope of the invention.

What is claimed is:

1. An airbag system for use in an avalanche comprising:

an inflatable balloon;

a pressure gas cylinder for holding a gas for use in inflating the inflatable balloon;

a valve, located between the inflatable balloon and the pressure gas cylinder, the valve capable of being placed in a closed state to retain pressurized gas in the pressure gas cylinder and in an open state to release pressurized gas from the pressure gas cylinder for use in inflating the inflatable balloon;

an ejector, located between the valve and the inflatable balloon, for conveying gas received from the pressure gas cylinder when the valve is in the open state and ambient air into the inflatable balloon;

a flow restrictor, located to receive gas from the pressure gas cylinder when the valve is in the open state before the gas is received by the ejector; and a harness for supporting the inflatable balloon, pressure gas cylinder, valve, ejector and flow restrictor adjacent to an individual's body.

2. An airbag system, as claimed in claim 1, wherein:

the flow restrictor is located to receive gas from the valve when the valve is in the open state.

3. An airbag system, as claimed in claim 1, wherein:

the flow restrictor is located to receive gas from the pressure gas cylinder before the gas is received by the valve when the valve is in the open state.

4. An airbag system, as claimed in claim 1, wherein:

the ejector is a single-stage ejector.

5. An airbag system, as claimed in claim 1, wherein:

the pressure gas cylinder has a volume that is less than 20 cubic inches of water.

6. An airbag system, as claimed in claim 1, wherein:

the flow restrictor creates a 2:1 pressure drop that boosts the ejector efficiency.

7. An airbag system for use in an avalanche comprising:

an inflatable balloon;

a pressure gas cylinder for holding a gas for use in inflating the inflatable balloon;

a valve, located between the inflatable balloon and the pressure gas cylinder, the valve having a cylinder-side port, a balloon-side port, and a movable block for use in placing the valve in: (a) a closed state in which pressurized gas is prevented from flowing from the cylinder-side port to the balloon-side port and (b) an open state in which pressurized gas is permitted to flow from the cylinder-side port to the balloon-side port for use in inflating the inflatable balloon;

a single-stage ejector, located between the valve and the inflatable balloon, for conveying gas received from the pressure gas cylinder when the valve is in the open state and ambient air into the inflatable balloon;

a flow restrictor, located to receive gas from the pressure gas cylinder before the gas is received by the ejector when the valve is in the open state; and a harness for supporting said inflatable balloon, pressure gas cylinder, valve, ejector and flow restrictor adjacent to an individual's body.

8. An airbag system, as claimed in claim 7, wherein:

the flow restrictor is located to receive gas from the valve when the valve is in the open state.

9. An airbag system, as claimed in claim 7, wherein:

the flow restrictor is located to receive gas from the pressure gas cylinder before the gas is received by the valve when the valve is in the open state.

10. An airbag system, as claimed in claim 7, further comprising:

a filling port for injecting gas into the pressure gas cylinder;

wherein the filling port communicates with the cylinder-side port at an intersection point.

11. An airbag system, as claimed in claim 10, wherein:

the flow restrictor is located to receive gas from the pressure gas cylinder before the gas passes the intersection point when the valve is in the open state.

12. An airbag system, as claimed in claim 7, wherein:

the valve is a pressure balanced valve.

13. An airbag system for use in an avalanche comprising:

an inflatable balloon;

a pressure gas cylinder for holding a gas for use in inflating the inflatable balloon;

a valve, located between the inflatable balloon and the pressure gas cylinder, the valve having a cylinder-side port, a balloon-side port, and a movable block for use in placing the valve in: (a) a closed state in which pressurized gas is prevented from flowing from the cylinder-side port to the balloon-side port and (b) an open state in which pressurized gas is permitted to flow from the cylinder-side port to the balloon-side port for use in inflating the inflatable balloon;

an ejector, located between the valve and the inflatable balloon, for conveying gas received from the pressure gas cylinder when the valve is in the open state and ambient air into the inflatable balloon;

a filling port for injecting gas into the pressure gas cylinder, the filling port communicating with the cylinder-side port at an intersection point;

a flow restrictor, located to receive gas from the pressure gas cylinder before the gas passes the intersection point when the valve is in the open state; and a harness for supporting said inflatable balloon, pressure gas cylinder, valve, ejector and flow restrictor adjacent to an individual's body.

14. An airbag system, as claimed in claim 13, wherein:

the balloon, when inflated, occupies a space that does not obscure the user's ability to see in a forward direction.

15. An airbag system, as claimed in claim 13, wherein:

the balloon, when inflated, occupies a space that does not obscure the user's ability to see in a peripheral direction.

16. An airbag system, as claimed in claim 13, wherein:

the balloon, when inflated, occupies a space that is not within the space defined by the normal range of motion of the user's legs.

17. An airbag system, as claimed in claim 13, wherein:

the balloon, when inflated, occupies a space behind the user's arms so that the user has the ability to move their arms over a substantial range of motion.

18. An airbag system, as claimed in claim 13, wherein:

the valve further comprises a handle for use in transitioning the valve from the closed state to the open state.

19. An airbag system, as claimed in claim 18, wherein:

the harness comprises a retainer for the handle that prevents the handle from being moved in a manner that causes an unintended placement of the valve in the open condition.

* * * * *

UNITED STATES PATENT AND TRADEMARK OFFICE

CERTIFICATE OF CORRECTION

PATENT NO. : 7,878,141 B2
APPLICATION NO. : 12/357383
DATED : February 1, 2011
INVENTOR(S) : Paynton et al.

It is certified that error appears in the above-identified patent and that said Letters Patent is hereby corrected as shown below:

Title Page;
At INID code (75), delete "Edgerty", and insert --Edgerly--.

Signed and Sealed this
Twenty-fifth Day of October, 2011

David J. Kappos

David J. Kappos
*Director of the United States Patent and Trademark Office*